US006160869A

United States Patent [19]

Zapalac et al.

[11] Patent Number: 6,160,869

[45] Date of Patent: Dec. 12, 2000

[54] CHICANE MAGNET FOCUSING SYSTEM AND DEFLECTION MAGNET FOR A SCANNING ELECTRON BEAM COMPUTED TOMOGRAPHY SYSTEM

[75] Inventors: Geordie Zapalac, San Francisco; Roy E. Rand, Palo Alto, both of Calif.

[73] Assignee: Imatron, Inc., So. San Francisco, Calif.

[21] Appl. No.: 09/165,244

[22] Filed: Oct. 1, 1998

[51] Int. Cl.[7] ..... H01J 35/14

[52] U.S. Cl. ..... 378/138; 378/4; 378/10; 378/137

[58] Field of Search ..... 378/10–16, 21–27, 378/137–142, 113, 4, 138; 250/396 R, 396 ML, 397–400

[56] References Cited

U.S. PATENT DOCUMENTS

| | | | |
|---|---|---|---|
| 3,007,087 | 10/1961 | Corpew . | |
| 4,352,021 | 9/1982 | Boyd et al. . | |
| 4,868,843 | 9/1989 | Nunan . | |
| 5,637,879 | 6/1997 | Schueler | 250/492.21 |
| 5,719,914 | 2/1998 | Rand et al. . | |
| 5,956,353 | 9/1999 | Nguyen et al. | 372/2 |

FOREIGN PATENT DOCUMENTS

0127983A2 12/1984 European Pat. Off. .

*Primary Examiner*—David P. Porta
*Assistant Examiner*—Allen C. Ho
*Attorney, Agent, or Firm*—Flehr Hohbach Test Albritton & Herbert LLP

[57] ABSTRACT

Tuning, integrating, and operating an electron beam CT scanning system is simplified by using the fringe field from dipole magnets arranged as a chicane to focus the electron beam, thus replacing conventional quadrupole and solenoid coils. Preferably four "chicane" dipole magnets are series-coupled with the windings in the downstream deflection magnet, such that the chicane magnet X and Y coils are energized 90° out of phase with the deflection magnet coils. The alternating current polarity in the chicane magnets creates an "S"-shaped electron beam trajectory that adequately uniformly focuses over the full cross-section of the electron beam. Winding the coils with a cosine distribution permits rotating the magnetic fields to change the azimuthal and deflecting planes of the electron beam, without disturbing the deflection angle and focusing properties. Chicane electrical current directions and magnet positions are such that the electron beam enters and exists the chicane on the axis of the scanning electron beam CT system. A new type of deflecting magnet is provided that has no end windings, and may be used in other beam optical systems.

20 Claims, 8 Drawing Sheets

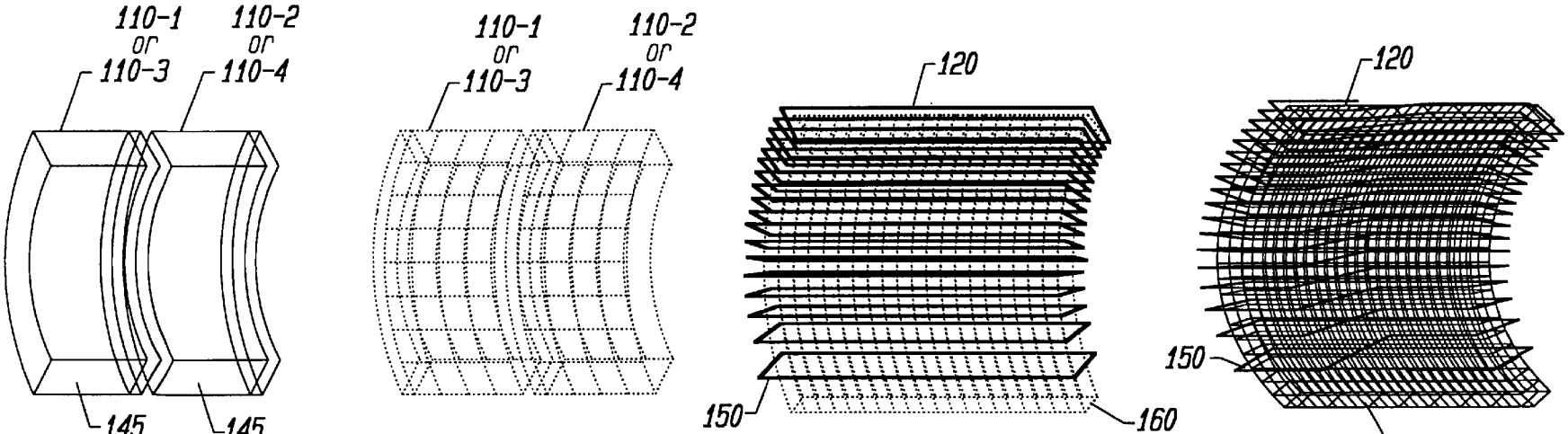
FIG. 6D
FIG. 6C
FIG. 6B
FIG. 6A
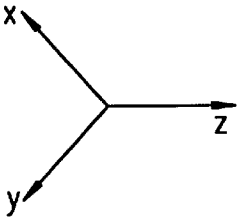
FIG. 6E

CHICANE MAGNET FOCUSING SYSTEM AND DEFLECTION MAGNET FOR A SCANNING ELECTRON BEAM COMPUTED TOMOGRAPHY SYSTEM

FIELD OF THE INVENTION

The present invention relates generally to focusing the electron beam in scanning electron beam computed tomographic X-ray systems, and more particularly to focusing a charged particle beam to an elliptical spot without using quadrupole coils.

BACKGROUND OF THE INVENTION

Scanning electron beam computed tomography ("CT") systems are described generally in U.S. Pat. No. 4,352,021 to Boyd, et al. (Sep. 28, 1982), and U.S. Pat. No. 4,521,900 (Jun. 4, 1985), U.S. Pat. No. 4,521,901 (Jun. 4, 1985), U.S. Pat. No. 4,625,150 (Nov. 25, 1986), U.S. Pat. No. 4,644,168 (Feb. 17, 1987), U.S. Pat. No. 5,193,105 (Mar. 9, 1993), and U.S. Pat. No. 5,289,519 (Feb. 22, 1994), all to Rand, et. al. Applicants refer to and incorporate herein by reference each above listed patent to Rand, et al.

FIGS. 1 and 2 depict a generalized scanning electron beam computed tomographic X-ray system 8, such as described in the above-referenced Rand et al. patents. Referring to FIG. 2, as used herein, the terms "upstream" and "downstream" refer to relative position of elements or components, in which "downstream" elements are located to the right of "upstream" elements, the most "upstream" element being electron gun 32. Thus, electron gun 32 is "upstream" from beam optical assembly 38 (which of course is "downstream" from electron gun 32), and beam optical assembly 38 is "upstream" from target 14 (which is "downstream" from electron gun 32, and from beam optical assembly 38. System 8 includes a vacuum chamber housing 10 in which an electron beam 12 is generated at the cathode of an electron gun 32 located in upstream region 34, in response to perhaps −130 kV high voltage. This potential accelerates the electron beam downstream along the chamber axis 28. Further downstream, beam optical assembly 38 causes the electron beam to scan at least one circular X-ray emitting target 14, located within a front lower portion 16 of housing 10. Z-axis 28 preferably is coaxial with electron beam 12 upstream from the beam optical assembly 38 and is the longitudinal axis of chamber 10, and the axis of symmetry for beam optics assembly 38 and electrode assembly 44.

Beam optical assembly 38 is sometimes referred to as a magnetic and deflecting lens system. Assembly 38 includes a magnetic solenoid system comprising a magnetic solenoid and trim solenoid coils (collectively 39), quadrupole and deflection coils (collectively 42), and an electrode assembly 44. Electrode assembly 44 may include a rotatable transverse field ion clearing electrode ("RICE"), a positive ion electrode 48 ("PIE"), and ion clearing electrodes ("ICEs"). Beam assembly 44 electrodes are mounted within housing 10 between electron gun 32 and coils 39 and 42 such that the electron beam 12 passes axially therethrough about axis 28.

As the electron beam passes through the vacuum chamber, it ionizes residual or introduced gas (e.g., nitrogen at $10^{-6}$ Torr) therein, producing positive ions. The positive ions are useful in the downstream chamber region where space-charge neutralization and beam self-focusing are desired. But in the upstream region, unless removed by an external electrostatic field the positive ions would be trapped in the negative electron beam, and the space-charge needed for desired beam self-expansion would be undesirably neutralized.

As described in U.S. Pat. Nos. 4,625,150, 5,193,105, and 5,289,519, positive ions may be removed from the beam with a device that creates transverse electric fields in the region between the electron gun and the PIE. One form of this device is a rotatable ion clearing electrode assembly, referred to as a "RICE" unit.

RICE element 44 and the ICE elements remove positive ions while maintaining a uniform electric field. These elements are disclosed in U.S. Pat. No. 4,625,150 to Rand, et al. As noted in U.S. Pat. No. 5,386,445 to Rand, various components of the ICE and RICE elements may in fact be dispensed with.

As disclosed in U.S. Pat. No. 5,193,105, 5,289,419, and 5,386,445, PIE 48 is a planar washer through whose center opening the electron beam passes. The PIE is coupled to a large positive potential (e.g., +2.5 kV) to produce an axial field that blocks positive ions from migrating upstream. PIE 48 sharply defines the interface between upstream region 34 (where ions are removed) and downstream region 36 (where ions accumulate and neutralize the beam).

Whereas electrode assembly 44 controls positive ions in the upstream region, coils 39 and 42 contribute a focusing effect to help shape the final beam spot as it scans one of the targets 14. The final beam spot at target 14 should be elliptically shaped.

Target 14 emits a moving fan-like beam of X-rays 18 when scanned by focused electron beam 12. X-rays 18 then pass through a region of a subject 20 (e.g., a patient or other object) and register upon a detector array 22 located diametrically opposite. The detector array 22 and target(s) 14 are coaxial with and define a plane orthogonal to the system axis of symmetry 28. The detector array outputs data to a computer system (indicated by arrows 24 in FIG. 1). The computer system processes and records the data to produce an image of a slice of the subject on a video monitor 26. The computer system also controls the system 8 and the electron beam production therein.

Image resolution is maximized and target heating is minimized by maintaining an elliptical electron beam profile at the target, with the major axis normal to the sweep direction of the beam. In the X-Z azimuthal plane (containing the sweep direction) the waist of the beam must be located at the target. However, preferably the beam waist in the Y-Z radial plane is located upstream of the target to prevent target damage in the event of a pressure burst in the scanner system's vacuum system. The on-target beam dimension in the radial plane is a design specification that must be kept constant. The on-target beam dimension in the azimuthal plane is determined by the beam emittance, and depends upon the design of the electron gun.

As noted, the electron beam scanning system deflects the electron beam off the central Z-axis to the target ring using a pair of X and Y orthogonal dipole deflection coils. By varying the current to the X and Y coils, the beam position is swept azimuthally around the target ring. In a conventional system, electron beam focusing involves adjusting the beam optical system with its quadrupole coils, main solenoid coil and trim solenoid coil. Electrical current through each of these coils must be separately controlled and varied as a function of time to achieve proper beam focus. Controlling all of the scanner optics, including two dipole coils, requires five separate time varying currents and one fixed current.

Although the quadrupole magnets provide a flexible mechanism to control the beam profile, this flexibility can greatly complicate tuning the electron beam. Unacceptable beam profiles that can damage the target may be generated. For example, the beam profile ellipse at the target may tilt out of the radial plane, or may assume an unacceptable size in the radial plane. U.S. Pat. No. 4,631,741 discloses the use of "W-wire" type monitors 56 (see FIG. 2) installed on a target ring to provide data useful in avoiding unacceptable and potentially dangerous beam profiles during beam tuning.

Thus, there is a need for a method and apparatus that focuses an electron beam spot on a target, without requiring quadrupole and solenoid coils, "W-wire" monitors, and the attendant time consuming adjustment. Preferably such method and apparatus should still provide flexibility in focusing and tuning the electron beam, and should prevent unacceptable beam profiles that may damage the target.

The present invention provides such a method and an apparatus.

SUMMARY OF THE INVENTION

The present invention eliminates the quadrupole and solenoid coils that conventionally are used to control focus in an electron beam CT scanner system. Electron beam focusing is instead controlled via a series-string of an even number of dipole magnets (a "chicane" of magnets) disposed upstream of the (scanner) final deflection magnet. Essentially the chicane magnets are used to provide beam focusing in the radial plane. By using an even number of chicane magnets whose current signs are alternated, uniform electron beam focusing is achieved. The end windings are eliminated from the scanner deflection magnet coils to reduce azimuthal focusing. An electrostatic lens function is achieved by controlling voltage coupled to a positive ion electrode ("PIE") to position the azimuthal waist of the electron beam at the X-ray producing target. Alternatively, PIE potential could be fixed and a trim solenoid could be retained to provide this function.

The chicane magnets are series-coupled with the deflection magnets such that the X and Y coils of the chicane magnets are energized 90° out of phase with the coils of the deflection magnet. The chicane magnetic coil windings preferably produce rotatable magnetic fields that can change the azimuthal plane of the electron beam, while leaving the deflection angle and focusing properties substantially unchanged.

Chicane magnet position and current directions are such that the electron beam enters and exits the chicane magnets on the scanner system Z-axis. Magnetic field polarity through the chicane magnets alternates between adjacent magnets.

The electron beam trajectory within a four magnet chicane system exhibits an "S"-shaped curve in an X-Z (azimuthal) plane. The off-axis component of the electron beam momentum permits focusing the electron beam using the dipole fringe fields between adjacent chicane magnets. The "S"-shaped curve provides an X-Z bend plane symmetry that permits electrons at differential initial positions in the bend plane to experience the same total focusing from the four chicane magnets. In addition to simplifying electron beam focusing, the present invention also prevents electron beam operation in potentially dangerous beam profile regimes.

The main deflection magnet used with the present invention is itself of novel design. In contrast to conventional main deflection magnets having "end" windings, in the present invention, the axial (inside) portions of the coils are connected to each other by wires outside the magnetic (mu-metal) yoke (or shield) of the magnet. Among other advantages, this configuration advantageously reduces azimuthal focusing due to fringe fields, and substantially eliminates aberrations due to end windings. Such a main deflection magnet can replace the conventional end-winding magnet commonly found in prior art electron beam CT scanner systems.

Other features and advantages of the invention will appear from the following description in which the preferred embodiments have been set forth in detail in conjunction with the accompanying drawings.

BRIEF DESCRIPTION OF THE DRAWINGS

FIG. 6A depicts a quarter-section of the magnetic mu-metal material used for forming two adjacent chicane dipole magnets, according to the present invention;

FIG. 6B depicts a quarter-section of a beamline boundary element model of two adjacent chicane dipole magnets, according to the present invention;

FIG. 6C depicts a quarter-section of a beamline boundary element model schematically showing wire winding coils for the deflection magnet, according to the present invention;

FIG. 6D depicts details of actual deflection magnet coil connections, according to the present invention;

FIG. 6E depicts angular orientation for FIGS. 6A–6D;

DESCRIPTION OF THE PREFERRED EMBODIMENTS

Figure 1:
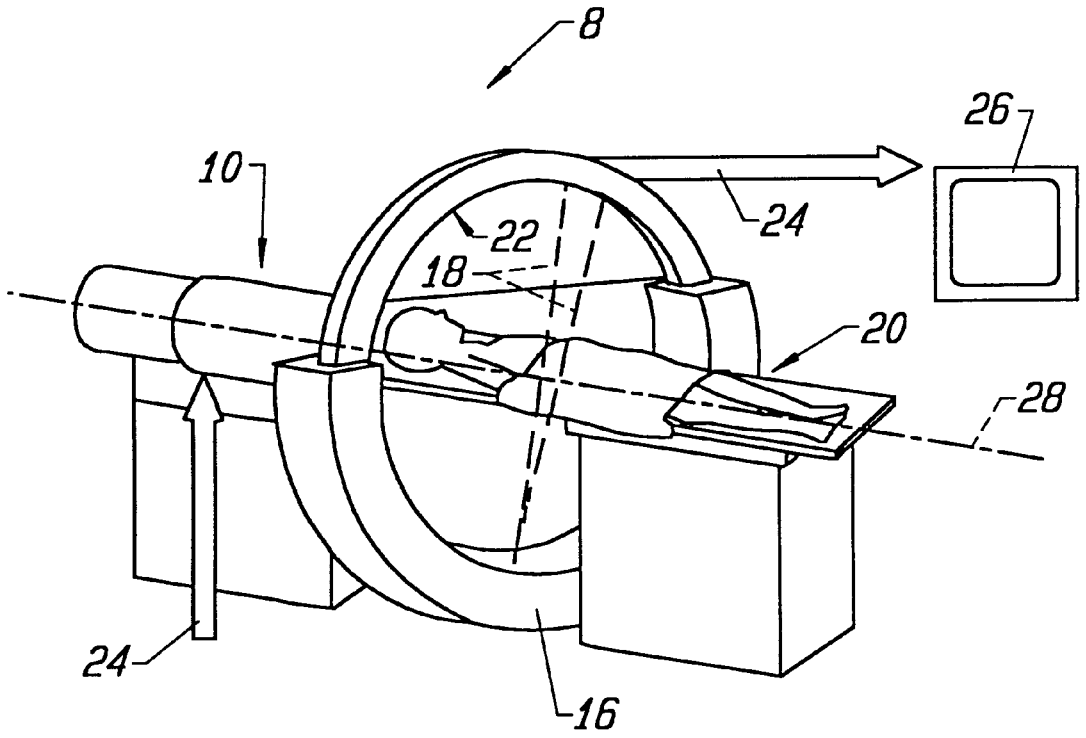
FIG. 1 PRIOR ART
FIG. 1 depicts a generalized scanning electron beam computed tomography X-ray system, with electron beam focusing according to the prior art.
Figure 2:
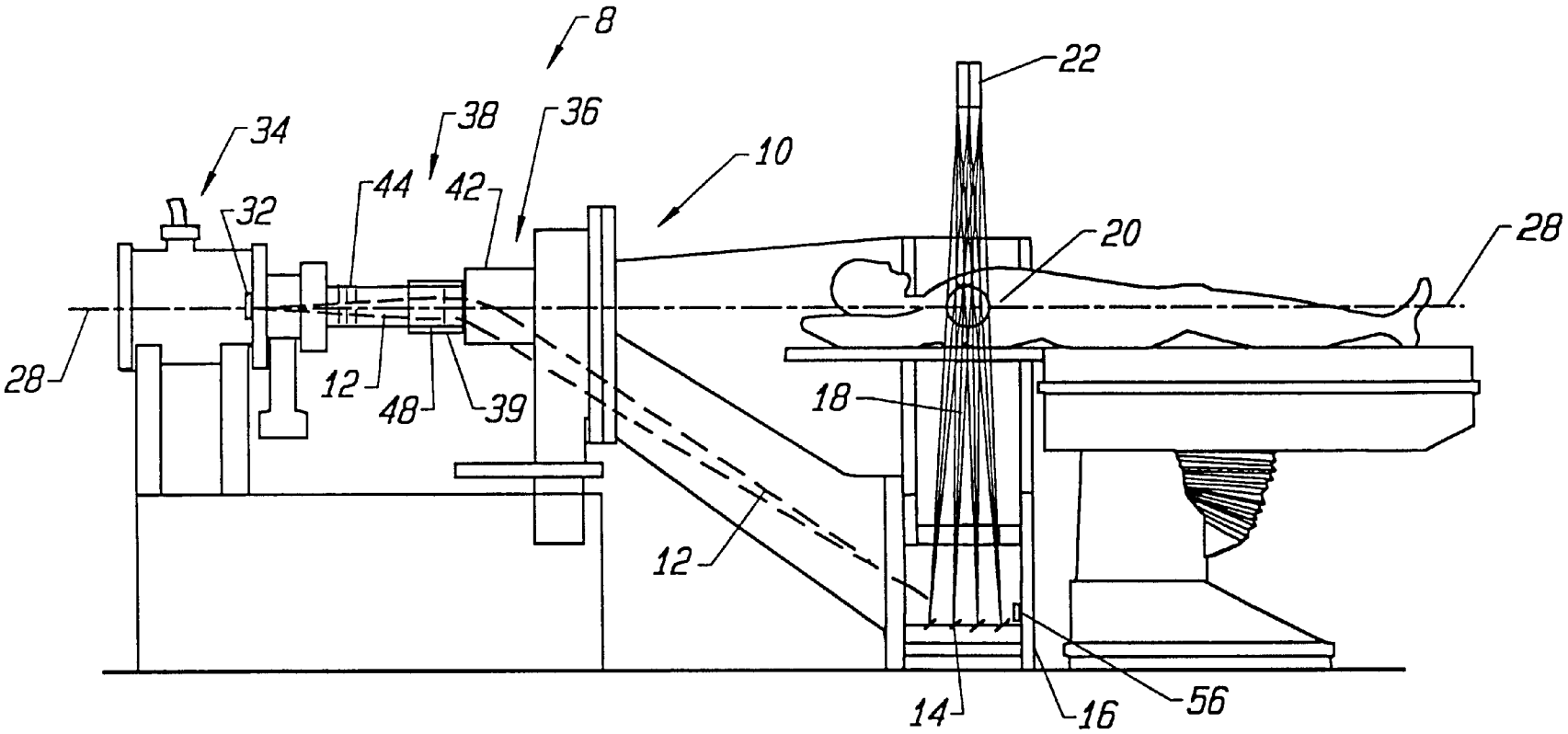
FIG. 2 PRIOR ART
FIG. 2 is a longitudinal cut-away view of the system shown in FIG. 1.
Figure 3:
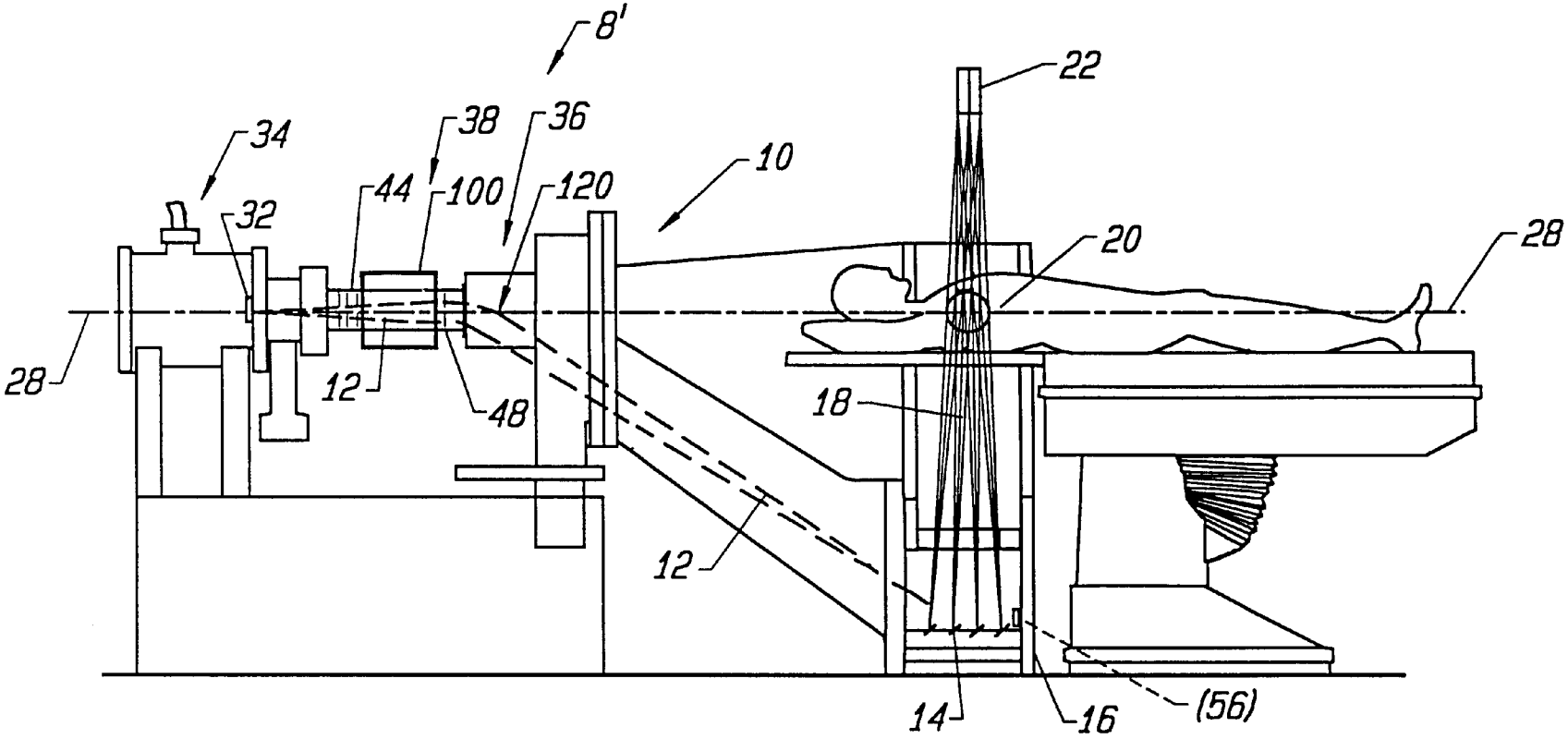
FIG. 3 is a longitudinal cut-away view of a generalized scanning electron beam computed tomography X-ray system with electron beam focusing according to the present invention.

FIG. 3 depicts a scanning electron beam computed tomography system 8' that differs from prior art system 8 with respect to the manner in which the electron beam is focused. In contrast to prior art system 8, electron beam focusing in system 8' does not require quadrupole coils and main and trim solenoid coils (39 in FIG. 2), and makes optional a need for "W-wire" monitors (56 in FIG. 2). Shown in FIG. 3 is a "chicane" magnet assembly 100, according to the present invention, which is used to focus the electron beam 12 upon target 14. As used in the field of electron optics, the term "chicane" denotes a set of magnets that brings a beam off-axis and then back on-axis.

Figure 4:
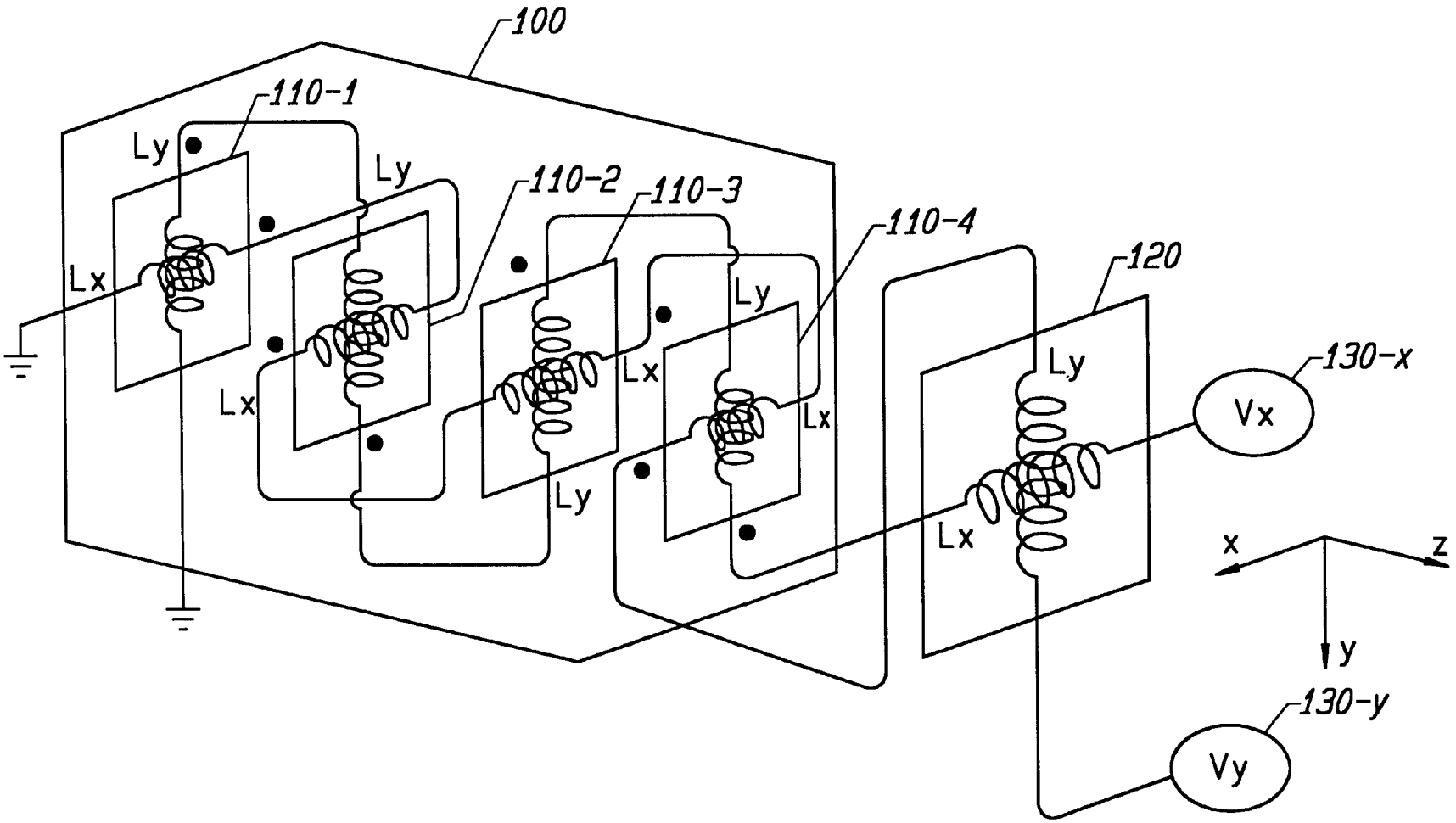
FIG. 4 is a schematic of a preferred series-coupling and energization of a chicane magnet assembly, according to the present invention.

In the embodiment of FIG. 4, chicane magnet assembly 100 preferably includes four series-coupled small dipole magnets, denoted 110-1, 110-2, 110-3, and 110-4. The use of these chicane magnets permits system 8' to function without quadrupole and solenoid coils that are required for beam focusing in the prior art. Chicane assembly 100 is disposed upstream of the final deflection magnet 120, coaxially with axis 28. As will be described, the chicane magnets provide beam focusing in a radial plane. By alternating the signs of the electrical current to adjacent chicane magnets, uniform electron beam focusing is achieved such that the beam enters the final deflection magnet on-axis. A positive ion electrode or PIE 48 (see FIG. 3) may be used as a lens to position the azimuthal waist of the electron beam at the X-ray producing target. Alternatively, the focusing function of the PIE may be provided by retaining the trim solenoid.

Referring still to FIG. 4, preferably four (an even number) chicane magnets are used, each of these magnets having an X-axis coil winding (Lx) and a Y-axis coil winding (Ly). The X-axis and Y-axis coil windings are oriented, respectively, parallel to the X-axis and Y-axis. The chicane magnet X-axis coil windings are series-coupled with the Y-axis coil winding Ly of the final deflection magnet 120. By the same token, the chicane magnet Y-axis coil windings are series-coupled with the X-axis coiling winding Lx of the final deflection magnet 120.

A first Vx drive generator 130-X energizes deflection magnet coil Lx and chicane coils Ly, and a second Vy drive generator 130-Y energizes deflection magnet coil Ly and chicane coils Lx. As Vx and Vy energizing output signals are varied, the electron beam position sweeps azimuthally about the X-ray emitting target. The above-described winding-interconnections result in energizing the X-axis and Y-axis chicane magnet windings 90° out of phase with the Lx, Ly coils of the deflection magnet.

Each chicane magnetic coil winding e.g., Lx, Ly, including the end windings, preferably is wound with a cosine distribution. Such winding distributions promote the production of rotatable chicane magnetic fields. These fields can rotate the X-Z azimuthal plane of the electron beam, while leaving the deflection angle and focusing properties substantially unchanged. A full description of cosine distribution wound magnets may be found in U.S. Pat. No. 4,644,168 to Rand, et al.

Figure 7B:
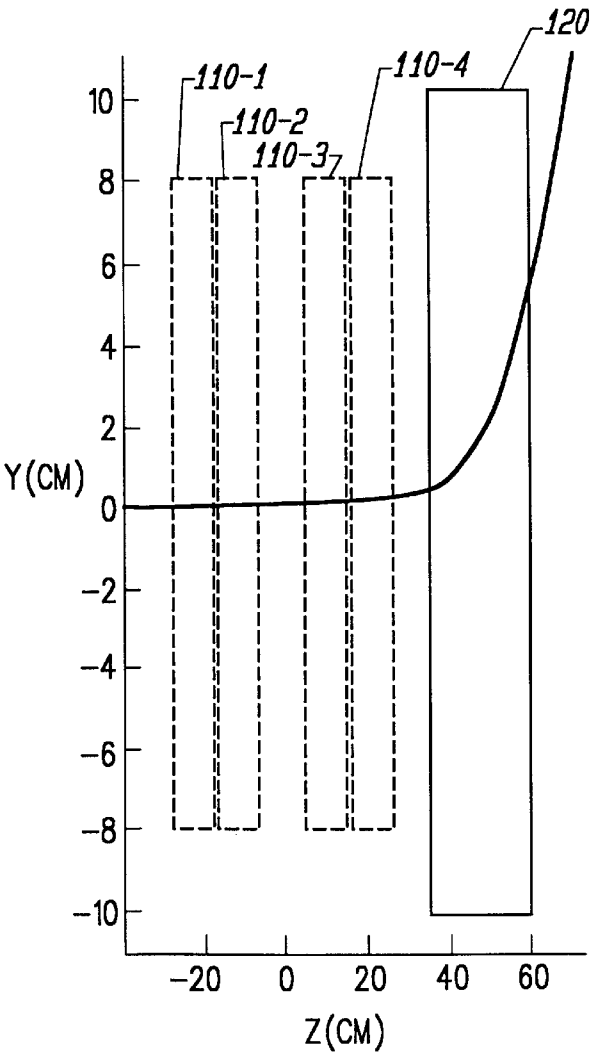
FIG. 7B depicts electron beam reference trajectory in a Y-Z radial plane for chicane and deflection magnets, according to the present invention.
Figure 7A:
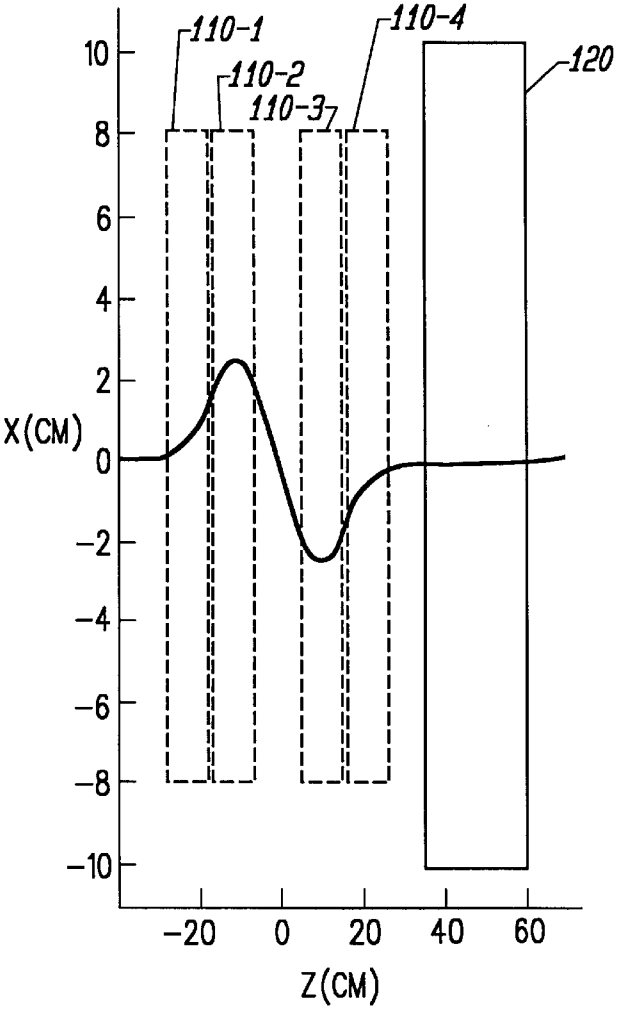
FIG. 7A depicts electron beam reference trajectory in an X-Z azimuthal plane for chicane and deflection magnets, according to the present invention.

The chicane magnet position and current directions are arranged such that the electron beam enters and exits the chicane magnets on the scanner system Z-axis 28. The current polarity through the chicane magnets alternates between adjacent magnets (as indicated by the winding polarity "dots" in FIG. 4). Thus, if the deflection magnet current is I, the current will be +I in chicane magnet 110-1, −I in chicane magnet 110-2, +I in chicane magnet 110-3, and −I in chicane magnet 110-4. This current orientation advantageously causes chicane system 100 to exhibit an "S"-shaped electron beam trajectory within the X-Z azimuthal plane, within the chicane magnets (as seen in FIG. 7A).

Further, as indicated by FIG. 4, it is preferred that the outermost chicane magnets 110-1, 110-4 have coil windings (Lx, Ly) with fewer (preferably 50% fewer) number of turns compared to the coil windings for the inner two chicane magnets 110-2, 110-3. Preferably the outermost chicane magnets (110-1, 110-4) have more (preferably twice the number) wire turns than are on the final deflection magnet windings Lx, Ly. The winding turn configuration for final deflection magnet 120 advantageously reduces this magnet's relative azimuthal focusing contribution. As will be described with respect to FIGS. 7A and 7B, the off-axis component of electron beam momentum allows focusing in the radial plane using the fringe fields between adjacent chicane magnets.

Figure 5:
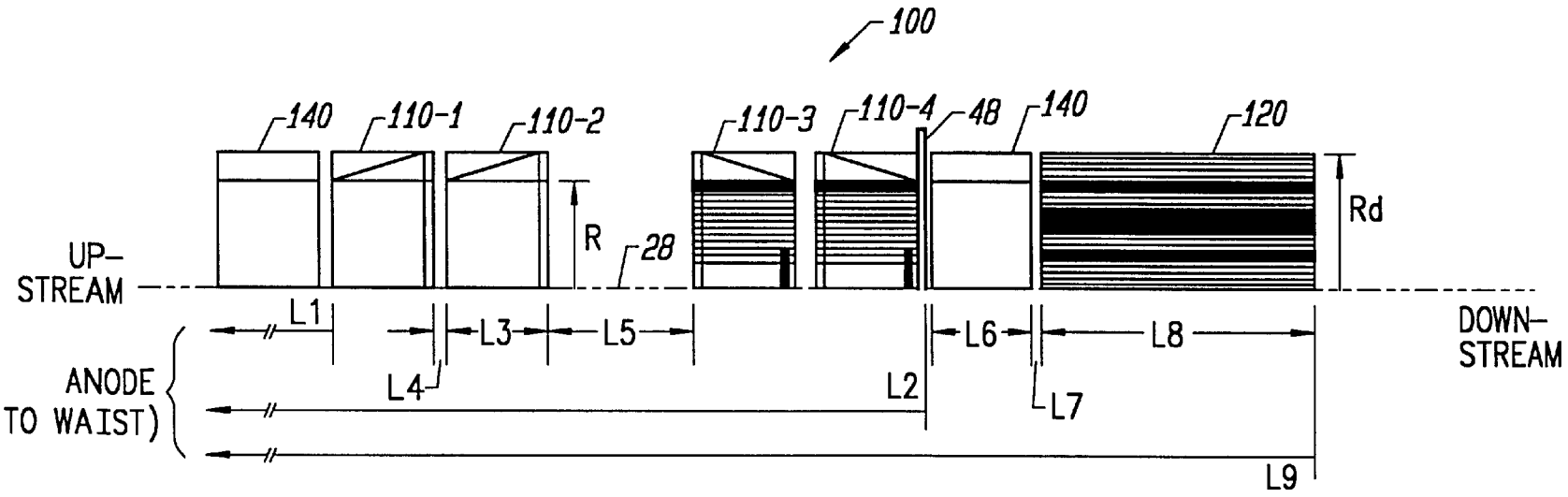
FIG. 5 depicts preferred aspects of geometry for a chicane magnet assembly, according to the present invention.

As best seen in FIG. 5, it is preferred that the innermost chicane magnets (110-2, 110-3) be spaced-apart from each other by a gap L5. The gap size will depend upon beam momentum and preferably is sized such that beam trajectory crosses the scanner axis at the midpoint of chicane magnet assembly 100.

In an exemplary configuration, the separation gap L5 could range from about 5% to 25% larger than the length L3 of a single chicane magnet. In this exemplary configuration, the initial waist of the electron beam was located at a distance L1≈157 mm upstream from first chicane magnet 110-1, and a distance L2≈726 mm from PIE 48. PIE 48 was modeled as a thin lens having an effective focal length of about 3750 mm. In FIG. 5, nominal length L3 for an exemplary Chicane magnet was about 94.16 mm, the gap L4 separating the first and second chicane magnets was about 6.44 mm, the gap L5 between the second and third chicane magnets was about 111.54 mm, and each chicane magnet had an inner radius R≈80 mm.

Referring now to the final deflection magnet 120, radius $R_d$≈101.5 mm, with each turn of deflection magnet 120 winding being essentially rectangular, with length≈240 mm, depth≈25 mm. In this preferred embodiment, the deflection magnet winding extended about 6.5 mm beyond a mu-metal collar 160 on all sides. Mu-metal collar 145 formed the sides of each chicane magnet, and mu-metal collar 140 separated the field due to deflection magnet 120 from the chicane field. Design considerations for the azimuthal distribution of the windings in a final deflection magnet 120 may be found in U.S. Pat. No. 4,644,168.

In FIG. 5, the space between fourth chicane magnet 110-4 and final dipole magnet 120 was occupied with mu-metal 140. The length L6 of mumetal 140 was about 84.18 mm, and mumetal 140 was spaced-apart from magnet 120 by a gap L7≈6.44 mm. Magnet 120 had a length L8≈238.78 mm, and its most downstream end was a distance L9≈1156.3 mm from the beam waist (which would be far to the left of FIG. 5). In the example described, electron beam kinetic energy was 130 KeV. It is understood that the dimensions and kinetic energy described are exemplary, and that different dimensions and kinetic energy could instead be used.

In the exemplary configuration of FIG. 5, the modulus of the current ("$I_O$") through all five dipole magnets was about 11.418 A. Polarity of current through chicane 1101 was positive, negative for chicane 110-2, positive for chicane 110-3, and negative for chicane 110-4. Chicane magnetic system 100 operates in conjunction with focusing effects from the fringe fields of the deflection magnet 120, and focusing from electron beam self-fields. Understandably it is desired to weaken deflection magnet fringe fields, preferably by eliminating end windings, so that the combined focusing of the chicane magnetic system and the deflection magnet is greatest in the radial plane.

It is important to appreciate that according to the present invention, while chicane magnets (110-1, -2, -3, -4) have end windings, final dipole 120 does not have end windings, As such, the main deflection magnet used with the present invention is itself of novel design. As described in U.S. Pat. No. 4,644,168 conventional main deflection magnets have "end" windings. By contrast, in the present invention, the axial (inside) portions of the coils are connected to each other by wires outside the magnetic (mu-metal) yoke 160 (or shield) of the magnet. By eliminating end windings from final dipole 120, the focusing effects from chicane system 100 are advantageously promoted. The resultant configuration advantageously reduces azimuthal focusing due to fringe fields, and substantially eliminates aberrations due to end windings.

Thus, according to the present invention, the magnetic field experienced by the electron beam arises almost entirely from the axial (inside) coil windings, the mu-metal yoke shielding the beam from the outside connections. Indeed, the configuration of final dipole magnet 120 permits its use as a substitute for the deflection magnet in a conventional prior art beam optics system found in many electron beam CT scanner systems.

In addition to the above noted advantages, the resultant main magnet is easier and less expensive to manufacture than prior art configurations.

FIGS. 6A–6D will now be described, with reference to the orientation depicted in FIG. 6E. FIG. 6A depicts a quarter-section of the magnetic mu-metal material 145 used for forming two adjacent chicane dipole magnets. In FIG. 6B, a quarter-section of a beamline boundary element model of two adjacent chicane dipole magnets is shown. In FIG. 6C, the quarter-section of a beamline boundary element model schematically depicts wire winding coils 150 for the deflection magnet, while FIG. 6D provides detail as to actual deflection magnet coil connections.

Thus, quarter-section beamline models in FIGS. 6A and 6B generally depict the shape of two adjacent chicane magnets (110-1 and 110-2, or 110-3 and 110-4), which as noted include end windings. By contrast, the quarter-section beamline model of FIG. 6C generally depicts the final deflection dipole 120, which according to the present invention does not have end windings.

Figure 7D:
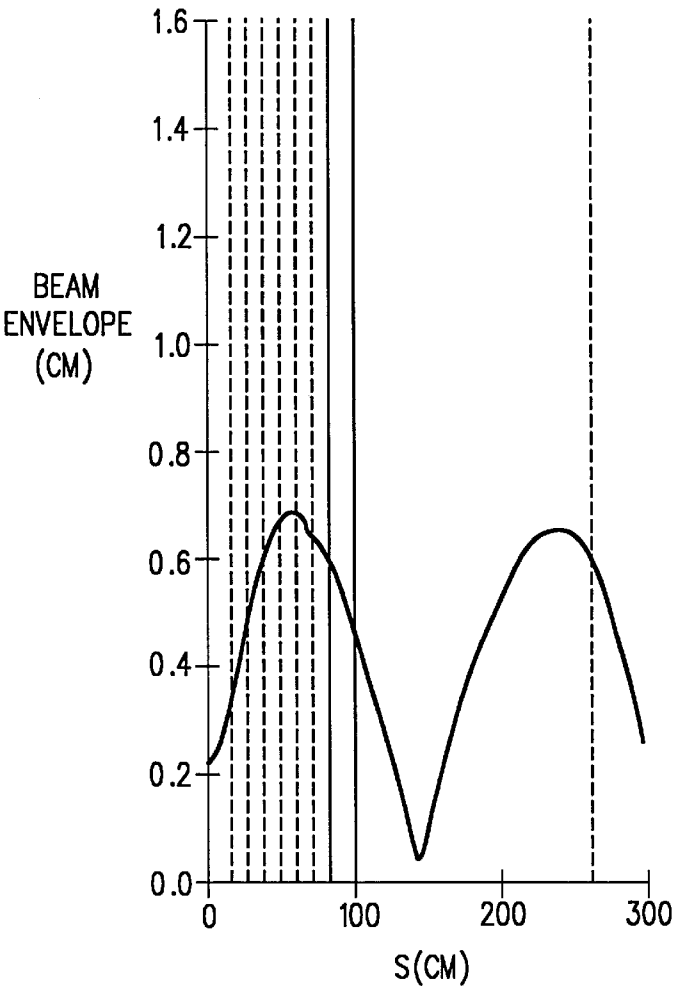
FIG. 7D depicts electron beam envelope in the Y-S (radial) plane, including effects of beam self-forces, according to the present invention.
Figure 7C:
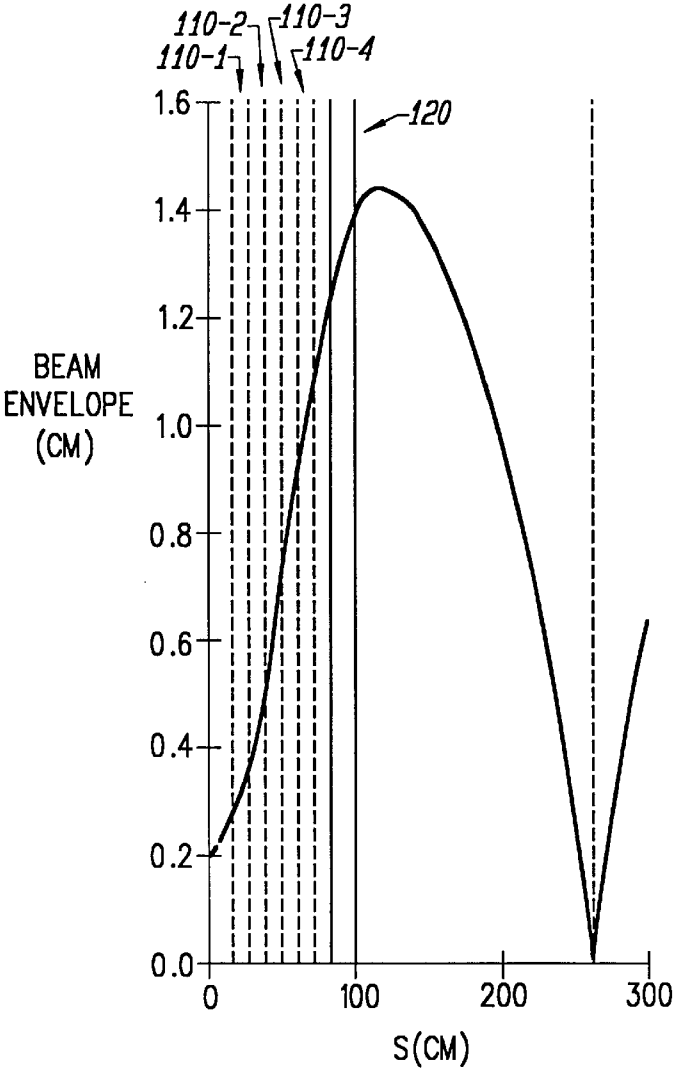
FIG. 7C depicts electron beam envelope in the X-S (azimuthal) plane, including effects of beam self-forces, according to the present invention.

FIG. 7A depicts an X-Z azimuthal plane reference electron beam trajectory for the chicane magnets (110-1, 110-2, 110-3, 110-4) and final deflection magnet (120) for the exemplary data described above. FIG. 7B depicts electron beam reference trajectory in a Y-Z radial plane for chicane and deflection magnets, according to the present invention. In FIGS. 7A and 7B, dashed lines depict the chicane magnets and solid lines depict the final deflection magnet. FIGS. 7C and 7D show dimensions of the beam in a coordinate system normal to the beam trajectory. The vertical lines in these figures denote magnetic boundaries and target positions. More specifically, FIG. 7C depicts the electron beam envelope in the X-S (azimuthal) plane, and includes the effects of beam self-forces. FIG. 7D depicts electron beam envelope in the YS (radial) plane, and also includes the effects of beam self-forces.

As noted, the X-Z bend plane symmetry resulting from the "S"-shape curve permits electrons at different bend plane initial positions to experience the same total focusing from the four chicane magnets. Within chicane system 100, the off-axis component of the electron beam momentum permits focusing the electron beam using the dipole fringe fields between adjacent chicane magnets.

The combined focusing effects from the magnets and beam self-forces are shown in FIGS. 7C and 7D.

In a preferred embodiment, PIE potential is adjusted to adjust the beam waist in the azimuthal plane to coincide with the target. The dimension of the on-target electron beam may then be adjusted by translating the chicane magnetic system and the deflection magnet with respect to the initial waist of the beam downstream from the electron gun. Azimuthal variations in the position of the waist near the target may be focused (e.g., tuned) using a deflection buffer such as disclosed in U.S. Pat. No. 5,224,137 to control PIE voltage. If desired, beam spot may be focused using the X-ray signal from a pin phantom, which would allow removal of the "W"-wire monitors required in the prior art.

Of course, alternatively the PIE potential could be fixed, and a smaller version of a trim solenoid could be retained. Such trim solenoid would be disposed upstream of the chicane magnets to permit adjusting the beam waist in the azimuthal plane to coincide with the target.

The present invention advantageously eliminates solenoids, quadrupoles, W-wires, and the various control electronics for each of the devices. In the present invention, the scanner system is controlled by two time-varying currents to the X-coils and Y-coils of the chicane magnetic system and the deflection magnets, and by one time-varying trim voltage to the PIE (or, if present, to a trim solenoid). The time-varying currents that steer the electron beam now also perform the additional function of focusing the beam to provide the required elliptical profile at the X-ray producing target.

Because the orientation of the dipole coils in the deflection magnet and in the chicane system are fixed, and because the magnetic fields may be rotated without distortion, the beam profile ellipse is constrained to be upright relative to the radial plane. The radial dimension of the beam profile is also constrained by placement of the optical elements in the beamline. Although small azimuthal variation in the radial dimension of the beam profile may not be readily removed by tuning, their contribution is relatively unimportant. Indeed, the inability to completely adjust the radial dimension of the beam is a desired safety feature that prevents damage to the X-ray target. Thus, in addition to simplifying electron beam focusing, the present invention also prevents electron beam operation in potentially dangerous beam profile regimes such as can occur in prior art quadrupole systems.

Modifications and variations may be made to the disclosed embodiments without departing from the subject and spirit of the invention as defined by the following claims. For example, electron beam focusing has been described for use in a scanning electron beam CT system, the method could be applied to other applications as well.

What is claimed is:

1. A system for focusing an electron beam spot upon an X-ray emitting target in a scanning electron beam CT X-ray system that includes an electron gun mounted within a vacuum housing chamber that has an upstream region, commencing with said electron gun, wherein the electron beam expands and has a downstream region, terminating at said X-ray emitting target, wherein the electron beam converges to form the beam spot, the system for focusing comprising:

a deflecting magnet having an X-axis deflecting coil winding and a Y-axis deflecting coil winding, disposed on a Z-axis projecting through said vacuum housing chamber at a downstream region of said X-ray system;

a chicane assembly of dipole magnets, disposed coaxially with and upstream from said deflecting magnet, each of said dipole magnets having an X-axis dipole coil winding coupled in series with said Y-axis deflecting coil winding, and having a Y-axis dipole coil winding coupled in series with said X-axis deflecting coil winding;

said X-axis deflecting coil winding and said Y-axis dipole coil windings being coupleable to a first source of current, and said Y-axis deflecting coil winding and said X-axis dipole coil windings being coupleable to a second source of current;

adjacent ones of said X-axis dipole coil windings being configured as to alternate polarity of electrical current passing therethrough responsive to said second source of current, and adjacent ones of said Y-axis dipole coil windings being configured as to alternate polarity of electrical current passing therethrough responsive to said first source of current;

wherein said dipole magnets create a magnetic field focusing said electron beam on said X-ray emitting target; and wherein operation of said system in potentially dangerous beam profile regimes is avoided.

2. The system of claim 1, wherein each of said dipole magnets has end windings, and said deflecting magnet has no end windings.

3. The system of claim 1, wherein said dipole magnets have at least one characteristic selected from a group consisting of (a) said dipole magnets produce magnetic fields that are rotatable as to follow change of an azimuthal plane of said electron beam without substantially altering electron beam deflection angle and focusing, (b) said dipole magnets produce magnetic fields that are rotatable as to follow change of a deflection plane of said electron beam without substantially altering electron beam deflection angle and focusing, (c) said dipole magnets produce magnetic fields that are rotatable as to follow change of an azimuthal plane and a deflection plane of said electron beam without substantially altering electron beam deflection angle and focusing, (d) said dipole magnets are wound with a cosine distribution, and (e) each of said dipole magnets is surrounded by a mu-metal shielding collar.

4. The system of claim 1, wherein adjacent said dipole magnets cause said electron beam to define a generally "S"-shaped trajectory in an X-Z azimuthal plane of said X-ray system such that said X-Z azimuthal plane is orthogonal to a deflection plane of said deflecting magnet;

said "S"-shaped trajectory starting and terminating on said Z-axis of said system.

5. The system of claim 1, wherein said dipole magnets are configured and energized such that symmetry is provided in a deflection plane of said chicane assembly of dipole magnets so as to permit electrons in said electron beam at different positions in said deflection plane of said chicane assembly of dipole magnets to experience an equal total focusing from all said dipole magnets.

6. The system of claim 1, wherein:

said chicane assembly comprises four said dipole magnets; and said dipole magnets have at least one characteristic selected from a group consisting of (a) outermost ones of said dipole magnets each have said coil winding with fewer turns than innermost ones of said dipole magnets, (b) outermost ones of said dipole magnets have more coil winding turns than are present on said deflecting magnet, and (c) innermost ones of said dipole magnets are spaced-apart from each other a gap distance dependent upon momentum of said electron beam.

7. The system of claim 1, further including at least one of (a) a positive ion electrode (PIE) disposed concentric with said Z-axis downstream of said dipole magnets and upstream of said deflecting magnet and coupleable to a voltage source causing said PIE to controllably position an azimuthal waist of said electron beam at said X-ray emitting target, and (b) a positive ion electrode (PIE) disposed concentric with said Z-axis downstream of said dipole magnets and upstream of said deflecting magnet and coupleable to a fixed magnitude voltage source, and a variable trim solenoid controllably positioning an azimuthal waist of said electron beam at said X-ray emitting target.

8. A system for focusing an electron beam spot upon an X-ray emitting target in a scanning electron beam CT X-ray system that includes an electron gun mounted within a vacuum housing chamber that has an upstream region, commencing with said electron gun, wherein the electron beam expands and has a downstream region, terminating at said X-ray emitting target, wherein the electron beam converges to form the beam spot, the system for focusing comprising:

a deflecting magnet having an X-axis deflecting coil winding and a Y-axis deflecting coil winding but having no end windings, disposed on a Z-axis projecting through said vacuum housing chamber at a downstream region of said X-ray system;

a chicane assembly of dipole magnets, disposed coaxially with and upstream from said deflecting magnet, each of said dipole magnets having an X-axis dipole coil winding coupled in series with said Y-axis deflecting coil winding, and having a Y-axis dipole coil winding coupled in series with said X-axis deflecting coil winding;

said X-axis deflecting coil winding and said Y-axis dipole coil windings being coupleable to a first source of current, and said Y-axis deflecting coil winding and said X-axis dipole coil windings being coupleable to a second source of current;

adjacent ones of said X-axis dipole coil windings being configured as to alternate polarity of electrical current passing therethrough responsive to said second source of current, and adjacent ones of said Y-axis dipole coil windings being configured as to alternate polarity of electrical current passing therethrough responsive to said first source of current;

wherein said dipole magnets create a rotatable magnetic field focusing said electron beam on said X-ray emitting target; and wherein operation of said scanning electron beam CT X-ray system in potentially dangerous beam profile regimes is avoided.

9. The system of claim 8, wherein said dipole magnets have at least one characteristic selected from a group consisting of (a) said dipole magnets produce magnetic fields that are rotatable as to follow change of an azimuthal plane of said electron beam without substantially altering electron beam deflection angle and focusing, (b) said dipole magnets produce magnetic fields that are rotatable as to follow change of a deflection plane of said electron beam without substantially altering electron beam deflection angle and focusing, (c) said dipole magnets produce magnetic fields that are rotatable as to follow change of an azimuthal plane and a deflection plane of said electron beam without substantially altering electron beam deflection angle and focusing, (d) said dipole magnets are wound with a cosine distribution, and (e) each of said dipole magnets is surrounded by a mu-metal shielding collar.

10. The system of claim 8, wherein said dipole magnets have at least one characteristic selected from a group consisting of (a) adjacent said dipole magnets cause said electron beam to define a generally "S"-shaped trajectory in an X-Z azimuthal plane of said X-ray system such that said X-Z azimuthal plane is orthogonal to a deflection plane of said deflecting magnet in which said "S"-shaped trajectory starts and terminates on said Z-axis of said system, and (b) said dipole magnets are configured and energized such that symmetry is provided in a [bend] deflection plane of said chicane assembly of dipole magnets permitting electrons in said electron beam at different positions in said bend plane to experience an equal total focusing from each of said dipole magnets.

11. The system of claim 8, further including means for controllably positioning an azimuthal waist of said electron beam at said X-ray emitting target, said means for controllably positioning including at least one mechanism selected from a group consisting of at least one of (a) a positive ion electrode (PIE) disposed concentric with said Z-axis downstream of said dipole magnets and upstream of said deflecting magnet and coupleable to a voltage source causing said PIE to controllably position an azimuthal waist of said electron beam at said X-ray emitting target, and (b) a positive ion electrode (PIE) disposed concentric with said Z-axis downstream of said dipole magnets and upstream of said deflecting magnet and coupleable to a fixed magnitude voltage source, and a variable trim solenoid controllably positioning an azimuthal waist of said electron beam at said X-ray emitting target.

12. The system of claim 8, wherein said chicane assembly comprises four said dipole magnets, and said dipole magnets have at least one characteristic selected from a group consisting of (a) an innermost pair of said dipole magnets have said coil windings with twice as many turns as coil windings on an outmost pair of said dipole magnets, (b) outermost ones of said dipole magnets have more coil winding turns than are present on said deflecting magnet, and (c) an innermost pair of said four dipole magnets are spaced-apart from each other a gap distance dependent upon momentum of said electron beam.

13. A final deflecting magnet for use in a scanning electron beam CT X-ray system that includes an electron gun mounted within a vacuum housing chamber that has an upstream region, commencing with said electron gun, wherein the electron beam expands and has a downstream regions terminating at an X-ray emitting target, wherein the electron beam converges to form the beam spot, comprising:

an X-axis deflecting coil winding and a Y-axis deflecting coil winding, disposed on a Z-axis projecting through said vacuum housing chamber at a downstream region of said X-ray system, wherein neither coil winding includes an end winding.

14. The final deflecting magnet of claim 13, further including:

a mu-metal shield surrounding each said coil winding;

generally axial wires connecting axial portions of each said coil winding to each other, said wires disposed external to said mu-metal shield.

15. The final deflecting magnet of claim 13, wherein said X-axis deflecting coil winding and said Y-axis deflecting coil winding are configured and coupled to each other to reduce at least one of (a) fringe field effects upon azimuthal focusing of said electron beam, and (b) end winding aberrations.

16. A method for focusing an electron beam spot upon an X-ray emitting target in a scanning electron beam CT X-ray system that includes an electron gun mounted within a vacuum housing chamber that has an upstream region, commencing with said electron gun, wherein the electron beam expands and has a downstream region, terminating with an X-ray emitting target, wherein the electron beam converges to form the beam spot, the method comprising the following steps:

(a) disposing a deflecting magnet having an X-axis deflecting coil winding and a Y-axis deflecting coil winding on a Z-axis projecting through said vacuum housing chamber at a downstream region of said X-ray system; and (b) upstream of said deflecting magnet and coaxial therewith, subjecting said electron beam to a chicane assembly of dipole magnets to produce at least one effect selected from a group consisting of (i) said assembly produces magnetic fields that are rotatable so as to follow change of an azimuthal plane of said electron beam without substantially altering electron beam deflection angle and focusing, (ii) said assembly produces magnetic fields that are rotatable to so as to follow change of a deflection plane of said electron beams without substantially altering electron beam deflection angle and focusing, (iii) said assembly produces magnetic fields that are rotatable so as to follow change of an azimuthal plane and a deflection plane of said electron beam without substantially altering electron beam deflection angle and focusing, (iv) said assembly causes said electron beam to define a generally "S"-shaped trajectory in an X-Z azimuthal plane of said X-ray system such that said X-Z azimuthal plane is orthogonal to a deflection plane of said deflecting magnet, (v) said assembly causes said electron beam to define a generally "S"-shaped trajectory in an X-Z azimuthal plane of said X-ray system in which said "S"-shaped trajectory starts and terminates on said Z-axis of said system, and (vi) said assembly is configured and energized to provide symmetry in said X-Z azimuthal plane permitting electrons in said electron beam at different positions in said X-Z azimuthal plane to experience an equal total focusing from all said dipole magnets;

wherein operation of said scanning electron beam CT X-ray system in potentially dangerous beam profile regimes is avoided.

17. The method of claim 16, wherein:

step (a) includes providing a said deflecting magnet having no end windings; and step (b) includes providing said chicane assembly of dipole magnets configured to create fringe dipole fields to focus said electron beam.

18. The method of claim 16, wherein step (b) provides said chicane assembly of dipole magnets with an even number of dipole magnets, each of said dipole magnets being wound with a cosine distribution.

19. The method of claim 18, wherein at step (b) said chicane assembly of dipole magnets includes four dipole magnets, wherein an inner pair of said dipole magnets have about 50% more turns than are on an outer pair of said dipole magnets.

20. The method of claim 19, wherein said outer pair of said dipole magnets have approximately 50% more turns than are on said deflecting magnet.

* * * * *